US005584749A

United States Patent [19]

Mitsuhashi et al.

[11] Patent Number: 5,584,749

[45] Date of Patent: Dec. 17, 1996

[54] SURFACE POLISHING APPARATUS

[75] Inventors: Masashige Mitsuhashi; Hideyuki Ono, both of Tokyo, Japan

[73] Assignee: NEC Corporation, Tokyo, Japan

[21] Appl. No.: 581,997

[22] Filed: Jan. 2, 1996

[30] Foreign Application Priority Data

Jan. 13, 1995 [JP] Japan ..... 7-004352

[51] Int. Cl.[6] ..... B24B 1/00

[52] U.S. Cl. ..... 451/285; 451/36; 451/41; 451/287

[58] Field of Search ..... 451/36, 41, 285, 451/287, 288, 289, 446, 456

[56] References Cited

U.S. PATENT DOCUMENTS

| | | | |
|---|---|---|---|
| 5,036,015 | 7/1991 | Sandhu et al. | 451/41 |
| 5,157,876 | 10/1992 | Medellin | 451/36 |
| 5,291,693 | 3/1994 | Nguyen | 451/41 |
| 5,308,438 | 5/1994 | Cote et al. | 451/41 |
| 5,421,769 | 6/1995 | Schultz et al. | 451/41 |

FOREIGN PATENT DOCUMENTS

| | | |
|---|---|---|
| 4-33336 | 2/1992 | Japan . |
| 5-69310 | 3/1993 | Japan . |
| 5-309559 | 11/1993 | Japan . |

*Primary Examiner*—Willis Little
*Assistant Examiner*—Eileen P. Morgan
*Attorney, Agent, or Firm*—Young & Thompson

[57] ABSTRACT

A surface polishing apparatus includes a disk-like polishing tool, a polishing solution spray mechanism, and a polishing solution suction mechanism. The polishing tool has a work surface to which a polishing solution is supplied and against which a workpiece is pressed. The polishing tool is driven/rotated to surface-polish the workpiece. The polishing solution supply mechanism is disposed on the upstream side of the workpiece in the rotational direction of the polishing tool to supply a polishing solution to the work surface of the polishing tool. The polishing solution suction mechanism is disposed on the downstream side of the workpiece in the rotational direction of the polishing tool to draw and recover the polishing solution on the work surface of the polishing tool.

10 Claims, 4 Drawing Sheets

SURFACE POLISHING APPARATUS

BACKGROUND OF THE INVENTION

The present invention relates a surface polishing apparatus for surface-polishing a plate-like workpiece, e.g., a semiconductor wafer, a wafer having an insulating film or a metal interconnection and used for a semiconductor circuit, a magnetic disk, or a glass substrate to a high degree of smoothness.

Recently, the surface polishing apparatuses disclosed in, e.g., Japanese Patent Laid-Open Nos. 4-33336, 5-69310, and 5-309559 have been used to polish semiconductor wafers, magnetic disks, and the like.

FIG. 7 shows a conventional surface polishing apparatus similar to those disclosed in the above references. In this surface polishing apparatus, a pressure holding plate 33 presses a workpiece 32 against the work surface (facing upward) of a disk-like polishing tool 31 which is rotated/driven. In this state, the apparatus performs surface polishing while supplying a polishing solution 34 to the work surface.

In the above conventional surface polishing apparatus, however, as shown in FIG. 8, with an increase in polishing time, the polishing rate (polishing amount/time) decreases because the work surface clogs up, and the polishing amount varies for each workpiece. In addition, since a polishing solution is discarded after it is used once, the running cost of a polishing solution is high.

SUMMARY OF THE INVENTION

It is an object of the present invention to provide a surface polishing apparatus which can prevent a decrease in polishing rate and make the process amount for each workpiece constant.

It is another object of the present invention to provide a surface polishing apparatus which can decrease the running cost by saving an expensive polishing solution.

In order to achieve the above objects, according to the present invention, there is provided a surface polishing apparatus comprising a disk-like polishing tool having a work surface to which a polishing solution is supplied and against which a workpiece is pressed, the polishing tool being driven/rotated to surface-polish the workpiece, polishing solution supply means, disposed on an upstream side of the workpiece in a rotational direction of the polishing tool, for supplying a polishing solution to the work surface of the polishing tool, and polishing solution suction means, disposed on a downstream side of the workpiece in the rotational direction of the polishing tool, for drawing and recovering the polishing solution on the work surface of the polishing tool.

DESCRIPTION OF THE PREFERRED EMBODIMENTS

Embodiments of the present invention will be described below with reference to the accompanying drawings.

First Embodiment

Figure 1:
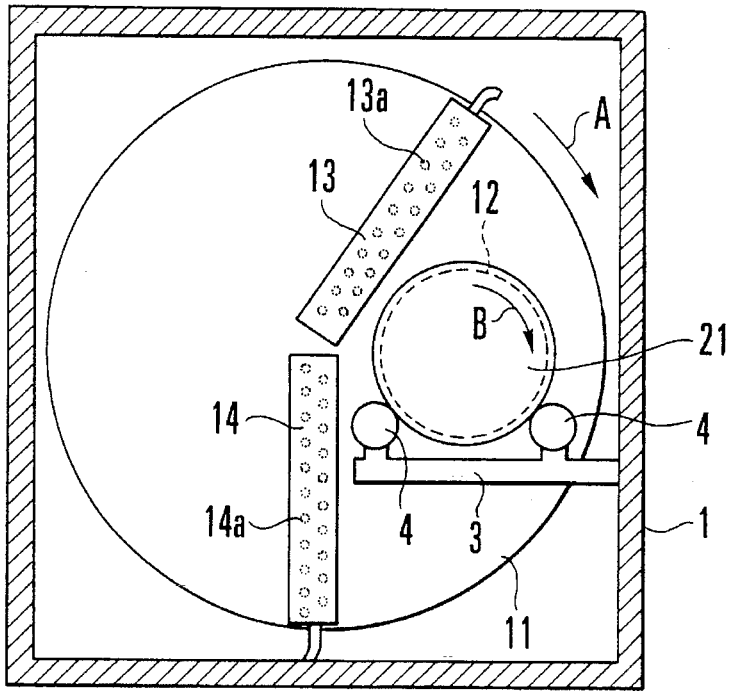
FIG. 1 is a plan view showing a surface polishing apparatus according to the first embodiment of the present invention.
Figure 2:
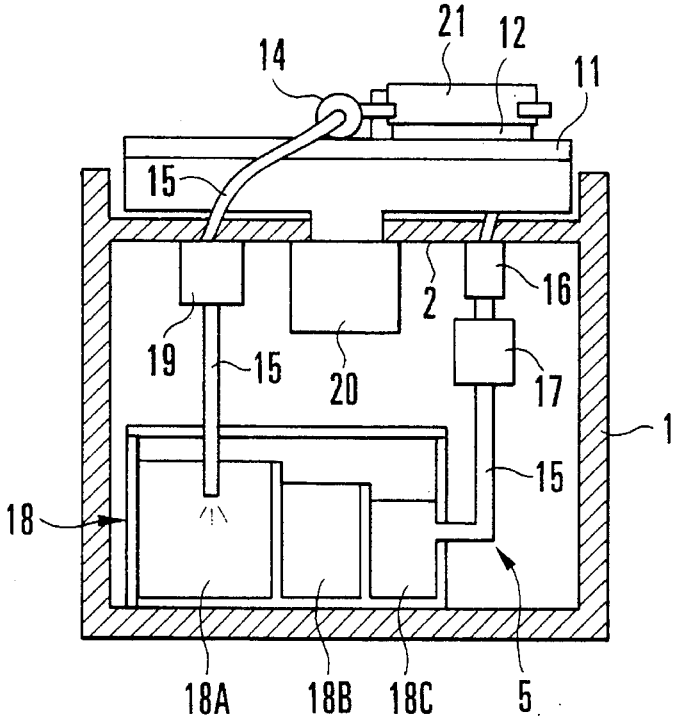
FIG. 2 is a side view showing the surface polishing apparatus of the first embodiment.

FIGS. 1 and 2 show a surface polishing apparatus according to the first embodiment of the present invention. Referring to FIGS. 1 and 2, a disk-like polishing tool 11 is rotatably mounted, with its work surface facing upward, on an upper frame 2 of a holder 1 of the surface polishing apparatus. The polishing tool 11 is rotated/driven in the direction indicated by an arrow A (the clockwise direction in FIG. 1) by a motor 20. A workpiece 12 is pressed against the work surface of the polishing tool 11 by a pressure holding plate 21. The pressure holding plate 21 and the workpiece 12 are placed on the work surface of the polishing tool 11, and are stopped at a set position by a pair of support rollers 4 of a horizontal frame 3, positioned in front of the workpiece 12, so as to be rotatable about its own axis with respect to the rotational direction of the polishing tool 11.

A rectangular parallelopiped polishing solution spray mechanism (polishing solution supply mechanism) 13 and a rectangular parallelopiped polishing solution suction mechanism 14 are disposed above the work surface of the polishing tool 11 in the radial direction of the polishing tool 11 while a gap (about 1 mm) is kept between the work surface and the mechanisms 13 and 14. The polishing solution spray mechanism 13 serves to spray a polishing solution against the work surface of the polishing tool 11 through small-diameter holes **13*a* in the bottom surface of the rectangular parallelopiped box. The polishing solution suction mechanism 14 serves to recover a polishing solution on the work surface of the polishing tool 11 by suction through small-diameter holes 14*a*** in the bottom surface of the rectangular parallelopiped box.

The polishing solution spray mechanism 13 is disposed on the upstream side of the workpiece 12 with respect to the rotational direction of the polishing tool 11. The polishing solution suction mechanism 14 is disposed on the downstream side of the workpiece 12 with respect to the rotational direction of the polishing tool 11. Both the mechanisms are supported by the holder 1 to cover the polishing tool 11 throughout its entire width in the radial direction.

Note that each of the small-diameter holes in the bottom surfaces of the polishing solution spray mechanism 13 and the polishing solution suction mechanism 14 has a diameter of about 1 mm, and these holes are arranged at a pitch of 3 mm.

A regenerative circulation unit 5 for regenerating a polishing solution recovered by the polishing solution suction mechanism 14 by suction and supplying the solution to the polishing solution spray mechanism 13 is mounted below the upper frame 2 of the holder 1. The regenerative circulation unit 5 includes a polishing solution tank 18 and a filter 16 for removing polishing chips. The polishing solution tank 18 stores the recovered polishing solution to remove foreign substances by a sedimentation filtering effect. The polishing solution tank 18 includes precipitation baths 18A, 18B, and 18C constituting a multi-stage (three-stage in this case) structure for sequentially causing an overflow of a polishing solution to flow to the downstream side. The partition walls of the precipitation baths 18A, 18B, and 18C are made to differ in height sequentially so as to cause an overflow of a polishing solution to sequentially flow from the precipitation bath on the upstream side to the precipitation bath on the downstream side.

The polishing solution suction mechanism 14 is connected to the precipitation bath 18A on the upstream side via a suction pump 19. The polishing solution spray mechanism 13 is connected to the precipitation bath 18C via a supply pump 17 and the filter 16. The suction pump 19 has a capability high enough to draw a polishing solution together with air from the polishing solution suction mechanism 14. The drawn air is processed by a mechanism (not shown) to hardly enter the polishing solution tank 18. The supply pump 17 has a capability corresponding to a supply amount of about 100 cc/min. The filter 16 removes foreign substances which cannot be removed by the precipitation baths 18A, 18B, and 18C in the polishing solution tank 18, and has a double mesh structures constituted by meshes of 3 μm and 0.2 μm.

The function of this apparatus will be described next.

When the polishing tool 11 starts to process the workpiece 12, the polishing solution spray mechanism 13 supplies a polishing solution to the work surface of the polishing tool 11. The polishing solution supplied to the work surface of the polishing tool 11 reaches a portion (to be worked) of the workpiece 12 upon rotation of the polishing tool 11. The workpiece 12 is polished by the friction caused between the polishing tool 11 and the workpiece 12 upon rotation of the polishing tool 11 and rotation of the workpiece 12 (in the direction indicated by an arrow B in FIG. 1).

The polishing solution used for polishing is drawn by the polishing solution suction mechanism 14 on the downstream side in the rotational direction of the polishing tool 11 immediately after the solution passes the workpiece 12. Polishing chips, polishing tool chips, and the like on the surface of the polishing tool 11 are removed in process together with the polishing solution, thereby always keeping the work surface clean.

This apparatus can therefore perform polishing efficiently for a long period of time without deceasing the polishing rate. In this case, since the polishing solution is supplied to the work surface of the polishing tool 11 and recovered therefrom throughout its entire width, polishing can be performed under the same condition regardless of the size of the workpiece 12.

The polishing solution drawn/recovered from the work surface of the polishing tool 11 by the polishing solution suction mechanism 14 is stored in the polishing solution tank 18 of the regenerative circulation unit 5, in which the solution sequentially flows into the precipitation baths 18A, 18B, and 18C. As a result, foreign substances from large substances to small substances are sequentially removed. The polishing solution in the last precipitation bath 18C is supplied again to the work surface of the polishing tool 11 by the polishing solution spray mechanism 13 through the pipe 15, the supply pump 17, and the filter 16. The polishing solution is therefore circulated/used many times to save the polishing solution.

A test result will be described in detail next.

In this test, a polyurethane tool (having a diameter of 25 inches) was used as the disk-like polishing tool 11, and colloidal silica (having a particle diameter of 100 Å) was used as a polishing solution. A wafer (workpiece) with a silicon dioxide film was polished.

In this test, when the rotation speed of the polishing tool 11 and the process pressure were set to be 24 rpm and 400 g/cm$^2$, the polishing rate was 1,500 ±50 Å/min in a cumulative polishing time of 10 hours. That is, the problem of a decrease in polishing rate with an increase in process time as in the conventional surface polishing apparatus was solved.

Such an effect can be obtained for the following reason. In a polishing process, the polishing solution spray mechanism 13 and the polishing solution suction mechanism 14 function in such a manner that a polishing solution supplied to the work surface of the polishing tool 11 is drawn immediately after the solution is used to polish the workpiece 12, polishing chips, polishing tool chips, and the like on the work surface of the polishing tool 11 are removed in process together with the polishing solution, and the clean polishing solution having passed through the filter 16 is supplied to the work surface.

Second Embodiment

The second embodiment of the present invention will be described next.

Figure 3:
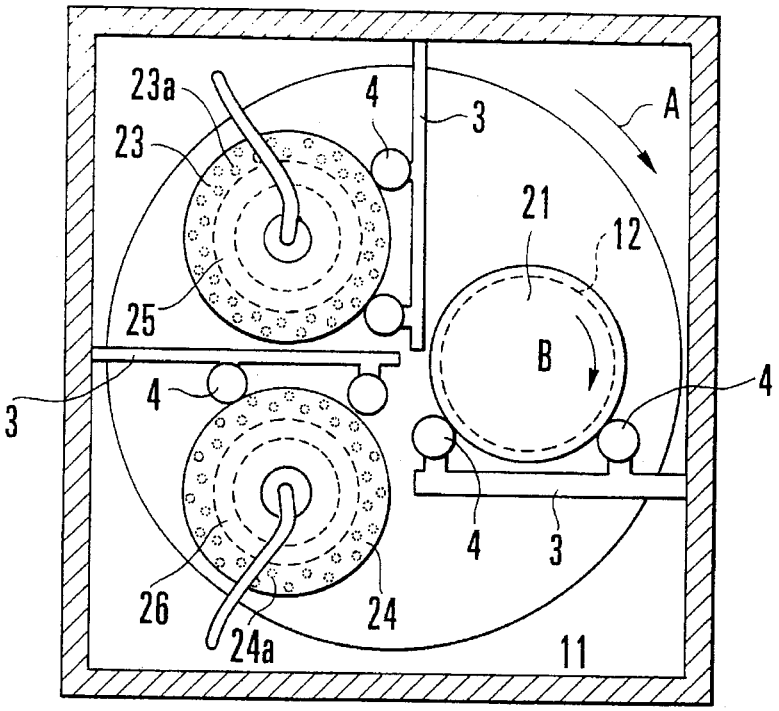
FIG. 3 is a plan view showing a surface polishing apparatus according to the second embodiment of the present invention.
Figure 4:
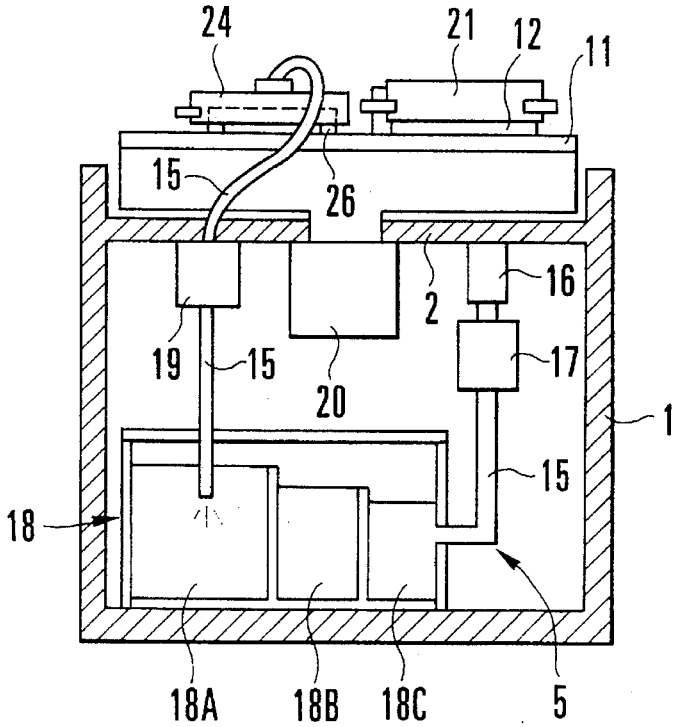
FIG. 4 is a side view showing the surface polishing apparatus of the second embodiment.

FIGS. 3 and 4 show the arrangement of a surface polishing apparatus according to the second embodiment of the present invention. In this surface polishing apparatus of the second embodiment, a disk-like polishing solution spray mechanism 23 is used as a polishing solution supply mechanism, and a disk-like polishing solution suction mechanism 24 is used as a polishing solution suction mechanism.

As shown in FIG. 3, each of the polishing solution spray mechanism 23 and the polishing solution suction mechanism 24 has a circular drum-like shape having a diameter larger than that of a workpiece 12. The polishing solution spray mechanism 23 is disposed behind the workpiece 12 with respect to a rotational direction A of a polishing tool 11. The polishing solution suction mechanism 24 is disposed in front of the workpiece 12 with respect to the rotational direction of the polishing tool 11.

The polishing solution spray mechanism 23 and the polishing solution suction mechanism 24 respectively have rings 25 and 26 (1 mm thick) on their bottom surfaces. Each ring has a diameter smaller than that of the bottom surface of each mechanism. The polishing solution spray mechanism 23 and the polishing solution suction mechanism 24 are mounted on the work surface of the polishing tool 11 with the rings 25 and 26. Each mechanism is stopped at a predetermined position by a pair of support rollers 4 of a horizontal frame 3, which is located in front of the mechanism, to be rotatable about its own axis with respect to the rotational direction of the polishing tool 11, as in the case of the pressure holding plate 21 described above.

The bottom surfaces of the polishing solution spray mechanism 23 and the polishing solution suction mechanism 24 have small-diameter holes (having a diameter of about 1 mm and arranged at a pitch of about 3 mm) 23*a* and 24*a* formed outside the rings 25 and 26. A polishing solution is sprayed and drawn through these small-diameter holes 23*a* and 24*a*.

The polishing solution spray mechanism 23 and the polishing solution suction mechanism 24 are connected to a regenerative circulation unit 5 as in the first embodiment. More specifically, the polishing solution suction mechanism 24 is connected to a precipitation bath 18A on the upstream side of a polishing solution tank 18 via a suction pump 19.

The polishing solution spray mechanism 23 is connected to a precipitation bath 18C on the downstream side via a supply pump 17, a filter 16, and the pipe 15. Note that rotatable type joints are used for the coupling portions between the pipe 15, the polishing solution spray mechanism 23, and the polishing solution suction mechanism 24.

The function of this apparatus will be described next.

When the polishing tool 11 starts to process the workpiece 12, the polishing solution spray mechanism 23 supplies a polishing solution to the work surface of the polishing tool 11. The polishing solution supplied to the work surface of the polishing tool 11 reaches a portion (to be worked) of the workpiece 12 upon rotation of the polishing tool 11. The workpiece 12 is polished by the friction caused between the polishing tool 11 and the workpiece 12 upon rotation of the polishing tool 11 and rotation of the workpiece 12 (in the direction indicated by an arrow B in FIG. 3). In this case, the polishing solution spray mechanism 23 also rotates about its own axis to evenly supply the polishing solution through the small-diameter holes while rotating.

The polishing solution used for polishing is drawn by the polishing solution suction mechanism 24 on the downstream side in the rotational direction of the polishing tool 11 immediately after the solution passes the workpiece 12. In this case as well, since the polishing solution suction mechanism 24 draws the polishing solution while rotating, the polishing solution can be evenly drawn/recovered. Therefore, polishing chips, polishing tool chips, and the like on the surface of the polishing tool 11 are removed in process together with the polishing solution, thereby always keeping the work surface clean.

This apparatus can therefore perform polishing efficiently for a long period of time without deceasing the polishing rate. In this case, the polishing solution can be evenly supplied to a wide range of the work surface of the polishing tool 11, and can be evenly recovered therefrom. The work surface can therefore be evenly kept in a good state.

Similar to the first embodiment, the polishing solution drawn/recovered from the work surface of the polishing tool 11 by the polishing solution suction mechanism 24 is regenerated by the regenerative circulation unit 5 and is supplied again to the work surface of the polishing tool 11. Since the polishing solution is circulated/used many times, the polishing solution can be saved.

A test result will be described in detail next.

This test was performed under the same conditions as those in the first embodiment. As a result, the polishing rate was 1,500±45 Å/min in a cumulative polishing time of 10 hours. That is, the problem of a decrease in polishing rate with an increase in process time as in the conventional surface polishing apparatus was solved.

Figure 5:
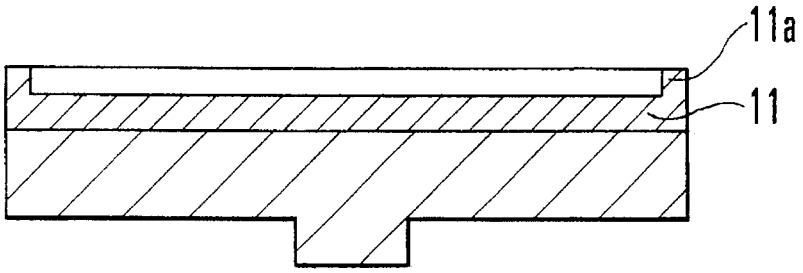
FIG. 5 is a longitudinal sectional view showing another polishing tool used in the first and second embodiments of the present invention.

The embodiments of the present invention have been described in detail above with reference to the accompanying drawings. However, the arrangements of the present invention are not limited to these embodiments. Various changes in design and the like can be made within the spirit and scope of the invention. For example, as shown in FIG. 5, an upright wall 11*a* may be formed on the edge portion of the work surface of the polishing tool 11 to prevent a polishing solution from flowing out. With this arrangement, since a polishing solution supplied to the work surface does not flow outside the work surface, the recovery efficiency of the polishing solution improves, resulting in a decrease in running cost.

Figure 6:
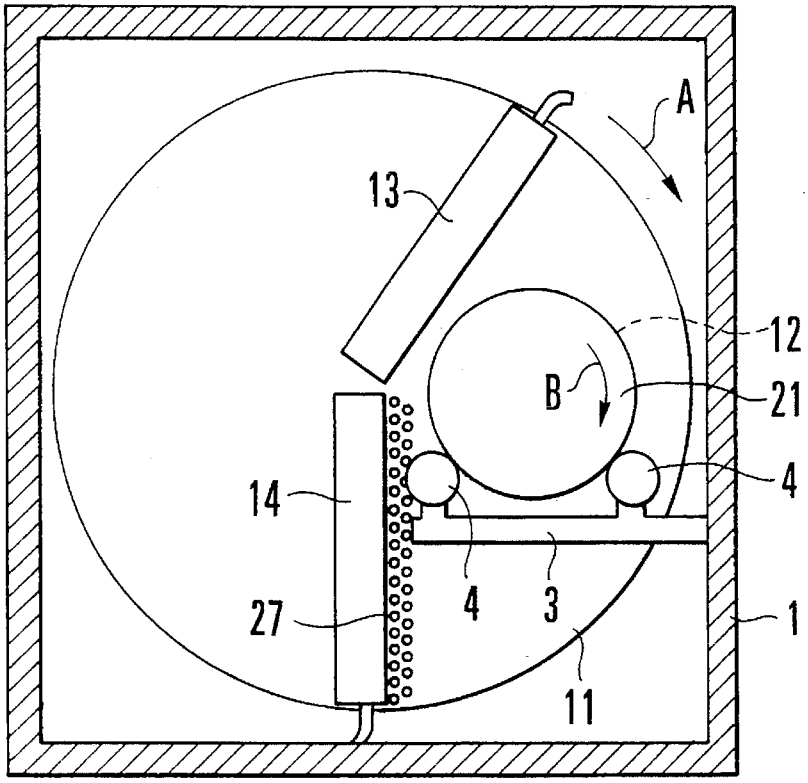
FIG. 6 is a plan view showing another rectangular parallelopiped polishing solution suction mechanism used in each embodiment of the present invention.
Figure 7:
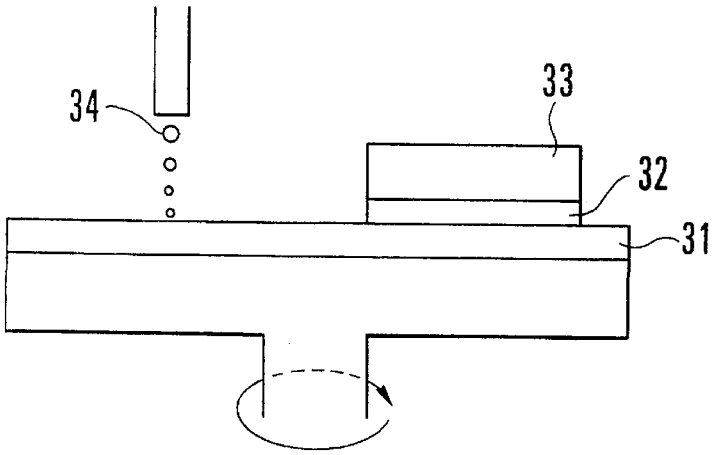
FIG.7 PRIOR ART
FIG. 7 is a side view of a conventional surface polishing apparatus.
Figure 8:
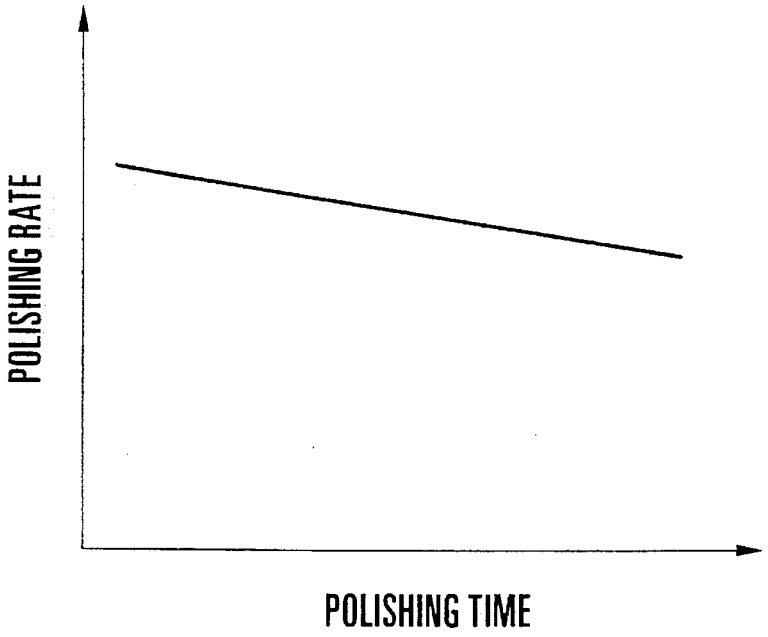
FIG.8 PRIOR ART
FIG. 8 is a graph for explaining the polishing rate of the conventional surface polishing apparatus.

In addition, as shown in FIG. 6, a brush 27 may be disposed behind the polishing solution suction mechanism 14 with respect to the rotational direction A of the polishing tool 11, i.e., between the polishing solution suction mechanism 14 and the workpiece 12, to contact the work surface of the polishing tool 11 throughout almost the entire width of the polishing tool 11 in the radial direction. With this arrangement, since polishing chips, polishing tool chips, and the like in recess portions of the work surface of the polishing tool 11 can be swept out, the suction efficiency improves.

The workpiece is not limited to a wafer with a silicon dioxide film, and includes other plate-like members such as a wafer with a metal interconnection, a magnetic disk, and a glass substrate.

As has been described above, according to the present invention, a polishing solution is removed from a work surface immediately after the solution is used, and at the same time, polishing chips and polishing tool chips are removed from the work surface, thereby preventing a polishing tool surface from clogging up, and always keeping the work surface clean. Therefore, even with an increase in polishing time, the polishing rate does not decrease. This prevents variations in polishing amount for each workpiece.

Since a polishing solution can be used many times through the regenerative circulation unit, a decrease in running cost can be attained.

Since a polishing solution is regenerated through a plurality of precipitation baths and a filter, a clean polishing solution can be circulated/used.

The process precision and process efficiency can be improved under the same conditions regardless of the size of a workpiece.

In addition, irregularity in supplying and drawing a polishing solution can be eliminated, and the entire work surface can be evenly kept in a good state.

Furthermore, since a polishing solution supplied to the work surface does not flow outside the work surface, the recovery efficiency improves, and a further reduction in running cost can be attained.

Moreover, since polishing chips and polishing tool chips in the recess portions of the work surface of the polishing tool are swept out, a further improvement in suction efficiency can be attained.

What is claimed is:

1. A surface polishing apparatus comprising:

a disk-like polishing tool having a work surface to which a polishing solution is supplied and against which a workpiece is pressed, said polishing tool being driven/rotated to surface-polish the workpiece;

polishing solution supply means, disposed on an upstream side of the workpiece in a rotational direction of said polishing tool, for supplying a polishing solution to the work surface of said polishing tool; and polishing solution suction means, disposed on a downstream side of the workpiece in the rotational direction of said polishing tool, for drawing and recovering the polishing solution on the work surface of said polishing tool.

2. An apparatus according to claim 1, further comprising a regenerative circulation means, connected between said polishing solution suction means and said polishing solution supply means, for regenerating the polishing solution recovered by said polishing solution suction means and supplying the polishing solution to said polishing solution supply means.

3. An apparatus according to claim 2, wherein said regenerative circulation means comprises:

a plurality of precipitation baths for storing the polishing solution recovered by said polishing solution suction means and removing foreign substances therefrom by a precipitation filtering effect, and sequentially causing an overflow of the polishing solution to flow out to a downstream side; and a filter connected between said precipitation baths and said polishing solution supply means and adapted to remove polishing chips in the polishing solution.

4. An apparatus according to claim 3, wherein said polishing solution supply means supplies a polishing solution to said polishing tool throughout an entire width thereof in a radial direction as a target area, and said polishing solution suction means draws a polishing solution from said polishing tool throughout the entire width thereof in the radial direction as a target area.

5. An apparatus according to claim 4, wherein said polishing solution supply means is constituted by a rectangular parallelopiped polishing solution spray mechanism elongated in the radial direction of said polishing tool and having many small-diameter holes through which a polishing solution is sprayed against the work surface of said polishing tool, and said polishing solution suction means is constituted by a rectangular parallelopiped polishing solution suction mechanism elongated in the radial direction of said polishing tool and having many small-diameter holes through which a polishing solution on the work surface of said polishing tool is drawn.

6. An apparatus according to claim 4, wherein said polishing solution supply means is constituted by a disk-like polishing solution spray mechanism rotatably disposed in correspondence with a radial portion of said polishing tool and having many small-diameter holes through which a polishing solution is sprayed against the work surface of said polishing tool, and said polishing solution suction means is constituted by a disk-like polishing solution suction mechanism rotatably disposed in correspondence with the radial portion of said polishing tool and having many small-diameter holes through which a polishing solution on the work surface of said polishing tool is drawn.

7. An apparatus according to claim 1, further comprising an upright wall formed on an edge portion of said polishing tool and adapted to prevent a polishing solution from flowing out.

8. An apparatus according to claim 1, further comprising a brush disposed between the workpiece and said polishing solution suction means to contact said polishing tool throughout substantially an entire width of the radial direction and adapted to scrape out polishing chips on the work surface.

9. A surface polishing apparatus comprising:

a disk-like polishing tool having a work surface to which a polishing solution is supplied and against which a workpiece is pressed, said polishing tool being driven/rotated to surface-polish the workpiece;

a rectangular parallelopiped polishing solution spray mechanism disposed on an upstream side of the workpiece in a rotational direction of said polishing tool and elongated in a radial direction of said polishing tool, said polishing solution spray mechanism having many small-diameter holes through which a polishing solution is sprayed against the work surface of said polishing tool;

a rectangular parallelopiped polishing solution suction mechanism disposed on the upstream side of the workpiece in the rotational direction of said polishing tool and elongated in the radial direction of said polishing tool, said polishing solution suction mechanism having many small-diameter holes through which a polishing solution is drawn from the work surface of said polishing tool; and a regenerative circulation unit constituted by a plurality of precipitation baths for storing the polishing solution recovered by said polishing solution suction means and removing foreign substances therefrom by a precipitation filtering effect, and sequentially causing an overflow of the polishing solution to flow out to a downstream side, and a filter connected between said precipitation baths and said polishing solution supply means and adapted to remove polishing chips in the polishing solution.

10. A surface polishing apparatus comprising:

a disk-like polishing tool having a work surface to which a polishing solution is supplied and against which a workpiece is pressed, said polishing tool being driven/rotated to surface-polish the workpiece;

a disk-like polishing solution spray mechanism disposed on an upstream side of the workpiece in a rotational direction of said polishing tool and positioned in correspondence with a radial portion of said polishing tool, said polishing solution spray mechanism having many small-diameter holes through which a polishing solution is sprayed against the work surface of said polishing tool;

a disk-like polishing solution suction mechanism disposed on a downstream side of the workpiece in the rotational direction of said polishing tool and positioned in correspondence with the radial portion of said polishing tool, said polishing solution suction mechanism having many small-diameter holes through which a polishing solution is drawn from the work surface of said polishing tool; and a regenerative circulation unit constituted by a plurality of precipitation baths for storing the polishing solution recovered by said polishing solution suction means and removing foreign substances therefrom by a sedimentation filtering effect, and sequentially causing an overflow of the polishing solution to flow out to a downstream side, and a filter connected between said precipitation baths and said polishing solution supply means and adapted to remove polishing chips in the polishing solution.

* * * * *